United States Patent [19]

Sandberg

[11] 4,346,372

[45] Aug. 24, 1982

[54] WINDOW OPERATOR WITH SWITCH TO OPERATE A BURGLAR ALARM

[75] Inventor: Christopher T. Sandberg, Owatonna, Minn.

[73] Assignee: Truth Incorporated, Owatonna, Minn.

[21] Appl. No.: 189,055

[22] Filed: Sep. 22, 1980

[51] Int. Cl.[3] ..... G08B 13/08

[52] U.S. Cl. ..... 340/545; 49/14; 200/61.62; 200/61.93; 340/541

[58] Field of Search ..... 340/545, 541, 542; 200/61.62, 61.84, 61.93; 49/13, 14; 116/86

[56] References Cited

U.S. PATENT DOCUMENTS

| | | | |
|---|---|---|---|
| 1,158,729 | 11/1915 | Scholl . | |
| 1,208,129 | 12/1916 | Fuller . | |
| 1,269,542 | 6/1918 | McNabb et al. . | |
| 2,086,800 | 7/1937 | Harris . | |
| 2,521,858 | 9/1950 | Levy | 340/545 |
| 2,773,995 | 12/1956 | Griswold . | |
| 3,330,922 | 7/1967 | Rowe | 200/61.93 |
| 3,401,578 | 9/1968 | Korber . | |
| 3,713,128 | 1/1973 | Wong et al. . | |
| 3,925,773 | 12/1975 | Green . | |
| 3,979,740 | 9/1976 | Forbat et al. . | |
| 4,005,397 | 1/1977 | Blair . | |
| 4,271,338 | 6/1981 | Rakocy | 200/61.93 |

*Primary Examiner*—Glen R. Swann, III

*Attorney, Agent, or Firm*—Wegner, McCord, Wood & Dalton

[57] ABSTRACT

A conventional roto-gear window operator for a casement or awning window, or the like, is provided with an alarm switch. The alarm switch consists of a conductive wire which is connected to a remote alarm package and is insulated from the base of the operator. One end of the wire is fixedly held adjacent to the helix of the operator worm gear so as to provide intermittent wiping contact when the worm gear is rotated. The worm gear is electrically conductive and, through the operator base, is connected to a lead wire which also extends to the alarm package. Accordingly, rotation of the worm gear (to actuate the operator) opens and closes the switch by engagement and disengagement of the wire with the worm gear helix, generating a sequence of pulses which triggers the alarm package.

14 Claims, 5 Drawing Figures

WINDOW OPERATOR WITH SWITCH TO OPERATE A BURGLAR ALARM

BACKGROUND OF THE INVENTION

1. Field of the Invention

This invention relates to a window operator for opening and closing a window and including a switch which triggers a burglar alarm, and more particularly, this invention relates to a window operator which opens and closes a circuit when moved so as to generate a sequence of electrical pulses which trigger the burglar alarm.

2. Background Art

It is frequently desirable to provide alarm mechanisms which signal that an intruder has broken into a building or dwelling. Numerous alarm systems providing this protection are on the market today. Unfortunately, many alarm systems are intended for use on doors only and thus provide no security against an intruder who enters through a window.

A few systems are in use which signal an intrusion through a window. In one type of system, a conductive strip is placed along the glass pane to detect any break in the glass. When the glass is broken, the current across the conductive strip is interrupted. That interruption triggers an alarm package which signals that there is an intruder by, for example, turning on lights or sounding a siren. This type of alarm system is triggered, however only by a break of the glass pane. If the window is left unlocked so that an intruder need not break the glass to enter, the alarm will not be triggered. Therefore, to receive the maximum protection from this type of alarm system, it is necessary that the window be closed and locked. Ventilation thus must be sacrificed for this protection. Reduced ventilation can be extremely undesirable, for example, in an unair-conditioned bedroom during hot weather.

Still another type of alarm system which has been used consists of a switch which is operated when a window is opened. These systems only detect a change in the window position, however, from a single fixed (usually closed) window position. Thus, the alarm system is only useful when the window is located in that single specific position. Accordingly, the window cannot be left open in whatever position provides the desired amount of ventilation.

The present invention is directed to overcoming one or more of the problems as set forth above.

SUMMARY OF THE INVENTION

A window operator is provided with a built-in alarm switch whereby rotation of the operator to open or close the window causes the alarm switch to trigger a remote alarm. The alarm switch consists of a lead fixedly held adjacent a movable member of the operator, the movable member having an irregular surface which intermittently engages the lead when rotated.

In the preferred embodiment, a conventional roto-gear window operator for a casement or awning window or the like is provided with an alarm switch. The alarm switch consists of a conductive wire which is connected to a remote alarm package and is insulated from the base of the operator. One end of the wire is fixedly held adjacent to the helix of the operator worm gear so as to provide intermittent wiping contact when the worm gear is rotated. The worm gear is electrically conductive and, through the operator base, is connected to a lead wire which also extends to the alarm package. Accordingly, rotation of the worm gear (to open or close the window) opens and closes the switch by engagement and disengagement of the wire with the worm gear helix so as to generate a sequence of pulses which triggers the alarm package.

A window having this alarm may be left open for ventilation since the alarm will be triggered by any change in the window position, no matter what position is selected. If an intended intruder reaches through the breach of the open window and turns the operator handle to open the window further, the alarm will be triggered.

Because this alarm switch may be added to almost any conventional roto-gear window operator, it is relatively inexpensive to manufacture. Special designing for a different operator is not required. This also provides a further safety feature in that the window operator appears the same, and feels the same when operated, as any other window operator. Thus, an intended intruder will not be alerted to the function of the operator.

Because of this similarity to conventional window operators, the alarm operator can be installed on conventional frames with only a minor modification. A one-half inch diameter hole may be drilled through the window sill for the two wires which extend between the operator and the alarm package. With this construction, the wires may be maintained inside the walls to protect them against tampering. This also hides the function of the operator from an intended intruder.

DESCRIPTION OF THE PREFERRED EMBODIMENT

Figure 1:
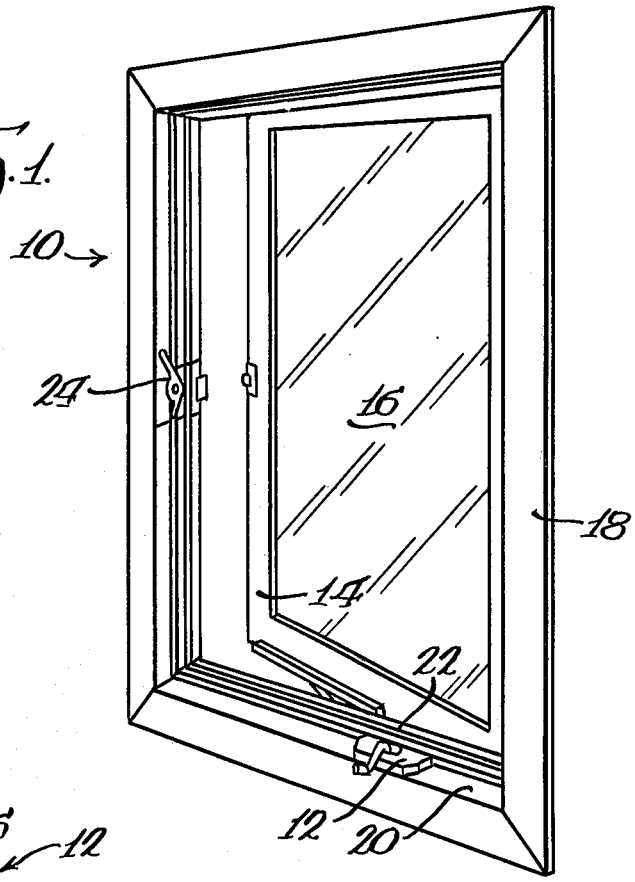
FIG. 1 is a perspective view of a casement window having the alarm operator.

A casement window 10 embodying the alarm operator 12 of this invention is shown in FIG. 1. The window sash 14 holding the window pane 16 is hinged to the right side of the window frame 18. The operator 12 is mounted on the window sill 20 and operates to pivot the window sash 14 in a suitable manner as will hereinafter be described. A cover 22 across the window sill 20 guards the components of the operator 12. A sash lock 24 is mounted on the left side of the window and operates in a conventional manner to lock the sash 14 completely shut. It should be understood that the alarm operator 12 will function for awning windows (with the sash hinges at the top of the frame) as well as for the casement window 10 shown.

Figure 2:
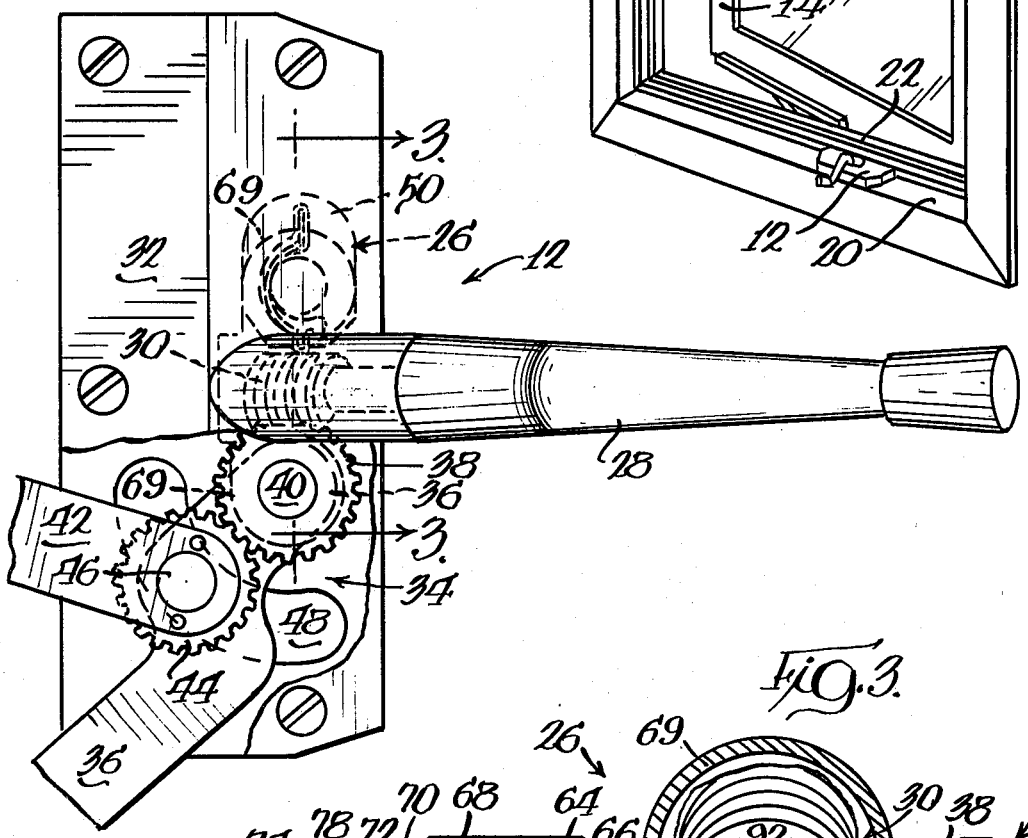
FIG. 2 is a plan view of the alarm operator showing the operator mechanism with the housing broken away and stop in phantom.

The alarm operator 12, as shown in FIG. 2, operates in essentially the same manner as conventional operators with the addition of the alarm switch 26 as is hereinafter detailed. Accordingly, the alarm operator 12 both appears and feels like a regular operator and would not be distinguishable by a potential intruder. As with conventional operators, the alarm operator 12 has a handle 28 connected to a worm gear 30 which is secured to the operator base 32 for rotation around a fixed axis.

A dual arm operator mechanism 34 is shown in the bottom portion of FIG. 2 for use with the alarm operator 12. A first operator arm 36 and a first gear 38 are freely pivotable around a pin 40 fixed to the operator base 32. The first gear 38 engages the worm gear 30. A second operator arm 42 is fixed to a second gear 44 for pivoting together around a pin 46 on the first operator arm 36. An arcuate depression 48 is provided in the base 32 and defines a track in which the head of the pin 46 moves during operation. The second gear 44 is in meshing engagement with the first gear 38. The operator arms 36,42 are connected to the window sash 14 through a linkage, the details of which are not shown, which controls pivoting of the sash 14 around its hinges. Further details of this operator mechanism 34 are specified in U.S. Pat. No. 4,241,541 issued Dec. 30, 1980 and assigned to the assignee of this application, the details of which are hereby incorporated by reference. The dual arm mechanism 34 is disclosed here only to exemplify one type of operator mechanism which may be used with this alarm operator 12. It is apparent that other window operators embodying a movable member having an irregular surface could be used with this invention.

Figure 3:
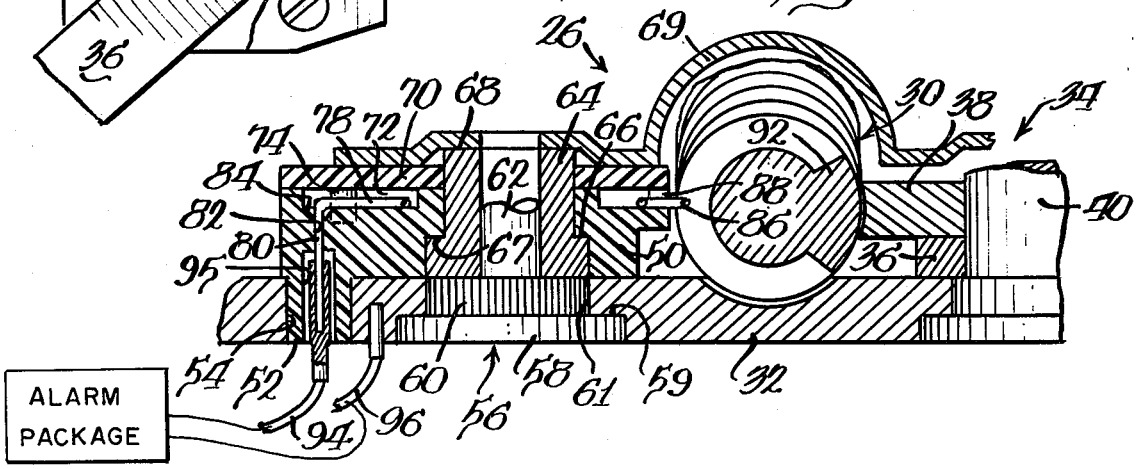
FIG. 3 is a cross-sectional view taken along line 3—3 in FIG. 2 showing the alarm switch.
Figure 4:
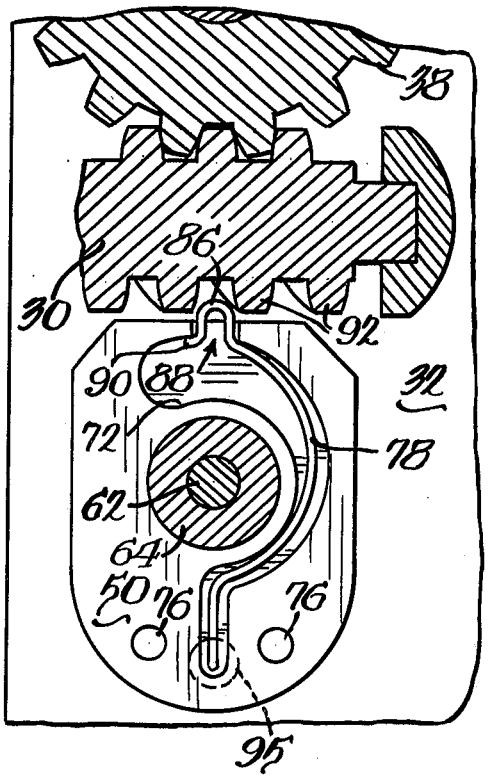
FIG. 4 is a cross-sectional plan view showing the alarm switch in an open position.
Figure 5:
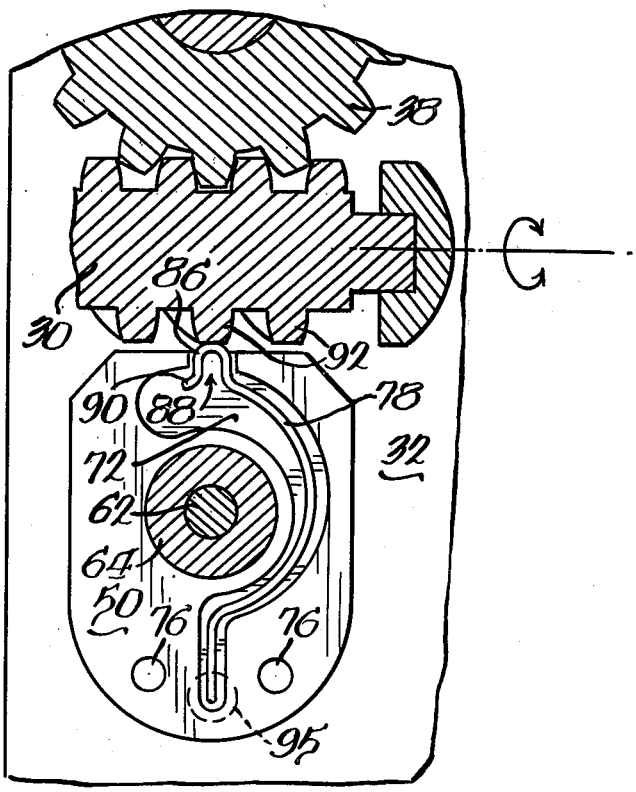
FIG. 5 is a view similar to FIG. 4 showing the alarm switch in a closed position.

The alarm switch 26, shown in phantom in FIG. 2, is shown in greater detail in FIGS. 3 through 5. A switch body 50 made of appropriate nonconductive material is disposed on the opposite side of the worm gear 30 from the operator mechanism 34. A polycarbonate material such as Lexan (Registered Trademark No. 902,420 of General Electric Company) is a suitable material.

A leg 52 extends from the bottom side of the switch body 50 through a hole 54 in the operator base 32. A standard rivet 56 extends through the base 32 and switch body 50 to fix the two parts together. The rivet head 58 fits within a recess 59 in the base 32 and an adjacent knurled section 60 snugly fits in the base opening 61 above that recess 59. The rivet shaft 62 extends upwardly from the knurled section 60.

A steel support bushing 64 encircles the rivet shaft 62. The support bushing 64 has segments with two different outer diameters, the abutment of the two defining a shoulder 66 which engages a mating shoulder 67 in the switch body 50. The upper end of the support bushing 64 defines a shoulder 68 which engages the stop 69. Suitable means (not shown) such as riveting the upper end of the rivet shaft 62 secures the stop 69 on the bushing 64.

The bushing 64, being made of much stronger material than the switch body 50 and switch cover 70, will therefore carry the compressive forces which occur when the attachment means such as a rivet are secured. The switch body 50 and cover 70 will merely be held in place between the stop 69 and operator base 32 and will not be compressed, thereby preventing damage.

The top surface of the switch body 50 contains a recess 72 which is generally in the shape of a question mark. The switch cover 70 is held in position above the switch body 50 by two guide pins 74 (one of which is shown in FIG. 3) which are received in guide holes 76 in the switch body 50. The recess 72 in the top of the switch body 50 is substantially enclosed by the cover 70. The switch cover 70 is absolutely held in place by sonic welding the cover 70 to the switch body 50.

A contact spring wire 78 is located in the recess 72 having a lead out 80 at one end which projects down through a hole 82 in the switch body leg 52. A chamfer 84 is provided at the top of the leg hole 82 to ensure that the spring wire 78 lies flat in the recess 72.

The opposite end of the spring wire 78 is U-shaped to define a contacting head 86 which projects through an opening 88 at that end of the switch body 50. The curvature of the main portion of the spring wire 78 is slightly greater than that of the recess 72 so that the wire 78 is bowed inwardly when within the recess 72. The resultant spring force in the wire 78 causes the contacting head 86 to be forced out the opening 88 as far as is possible. A slight bend 90 at the end of the wire 78 limits movement of the head 86 out the opening 88 to a desired amount. The head 86 may thus engage the worm gear helix 92 to close the switch and operate the alarm package as will be described below.

The lead out 80 of the spring wire 78 is connected to a first lead wire 94 which extends to the remote alarm package. The lead out 80 and first lead wire 94 are insulated from the operator base 32 by the switch body leg 52. An enlarged diameter hole 95 is provided at the bottom of the leg 52, leaving sufficient room for the connection of the spring wire 78 and the first lead wire 94.

A second lead wire 96 is connected to the base 32 and also extends to the remote alarm package. It is preferred that the second lead wire 96 to be located next to the switch body leg 52 so that both the lead wires 94,96 may be extended through a small hole in the window sill 20. A conventional window frame 18 can thus be used by modifying it to include a one-half inch diameter hole through its sill 20. The wires 94,96 are extended through the hole in the window sill 20 and into the wall to the remote alarm package. This not only protects the circuitry against tampering; it also hides the circuitry to make the alarm operator 12 appear the same as conventional operators.

When the contacting head 86 of the spring wire 78 engages the worm gear helix 92, as shown in FIG. 5, a circuit through the alarm package is closed. The circuit runs from the alarm package through the first lead wire 94 and spring wire 78 to the worm gear 30. The alarm package includes a power source (generally nine volts to prevent shocks) which generates a current which is carried through the worm gear 30 to the operator base 32 and second lead wire 96 and back to the alarm package. When the contacting head 86 does not contact the worm gear helix 92, the circuit is broken.

It is apparent that opening and closing of the circuit is caused by the turning of the worm gear 30. When the handle 28 and the worm gear 30 are rotated, the worm gear helix 92 intermittently contacts the wire contacting head 86 to open and close the circuit and, therefore, generate a pulse. The wiping contact between the wire contacting head 86 and worm gear helix 92 is highly reliable.

This invention should not be understood as being limited to embodiments in which the contacting head 86 engages a worm gear helix 92. It is apparent that other members having irregular surfaces could be used in conjunction with the wire contacting head 86 and provide similar operational characteristics. For example, the switch body 50 could be positioned next to a cam surface which is rotated by the handle or it could be positioned next to a gear in the window operator mechanism. The degree of rotation resulting in intermittent wiping with the contacting head 86 could be changed as desired by changing the surface shape.

One suitable alarm package providing the operational characteristics desired in conjunction with the alarm operator 12 functions as follows. Upon the closing of the switch 26 located in the alarm operator 12, a first latch in the alarm package is actuated which in turn causes a delay circuit to begin charging a capacitor. During the operative portion of the delay function, a second latch is enabled and will be switched to an active state if a second pulse from the switch 26 is coupled within a certain period of time to the second latch through the first latch. A suitable delay period would be on the order of a few seconds. Once the second latch is actuated, the alarm is triggered. If, on the other hand, a second pulse is not coupled to the second latch during the delay period, then the first latch will revert to its former state and the circuit will prevent triggering of the alarm.

By requiring a certain sequence of pulses to occur before triggering the alarm, false alarms are greatly lessened. Window chatter resulting from fluctuating wind loads can cause the window pane 16 and sash 14 to move slightly. That movement can, in turn, cause the worm gear 30 to rotate slightly and thus move into and out of engagement with the contacting head 86 of the spring wire 78, thereby opening and closing the alarm switch 26. By requiring that two pulses be generated within a given short time span, the chances of window chatter resulting in a false alarm are greatly reduced. Without the time limit, changes in wind load may trigger the alarm even though occurring at greatly different times.

The alarm package may thus be used with the window sash 14 in any position by turning the operator handle 28 to locate the sash 14 as desired and then turning on the alarm package. Accordingly, the alarm may be set even when the window is partially open to provide ventilation. If an intruder reaches through the breach of the open sash 14 and turns the handle 28 to open the sash 14 further, the turning of the handle 28 will cause the switch 26 to generate the pulse sequence which triggers the alarm.

The alarm operator 12 is also effective when the window sash 14 is completely shut. Normally, an intended intruder will not break the window pane 16 and then crawl through the opening. Rather, to avoid being cut by the glass around the sides of the window sash 14, the intruder will reach through the opening and turn the handle 28 to open the sash 14. When he does that, the pulse sequence is generated which triggers the alarm.

The alarm package can be modified to provide a variety of modes of alarm, including the sounding of a horn or siren, turning on of lights, communicating with a central alarm system, or any combination thereof. And, of course, the alarm operator 12 may be used in the homes having other security systems.

Other aspects, objects and advantages of this invention can be obtained from a study of the drawings, the disclosure and the appended claims.

I claim:

1. A window operator having means for generating an electric signal in response to operation of the window operator comprising:

a casing mountable on a window frame;

operator linkage means rotatably mounted within the casing and extending from said casing and connectable to a window sash;

rotatable means within said casing responsive to rotation of a handle and connected to said operator linkage means for causing rotation of the last mentioned means;

a circuit closing element positioned within said casing adjacent said rotatable means; and said rotatable means having an irregular surface which intermittently engages said element for activation thereof.

2. A switch for generating a sequence of electrical pulses to trigger an alarm package when the worm gear of a roto-gear window operator is rotated, comprising:

a first wire electrically connected to said worm gear, said worm gear being one side of the switch;

a second wire on the other side of the switch, said second wire having a head end fixed adjacent said worm gear for intermittent wiping contact with the helix of said worm gear when said worm gear is rotated.

3. The switch of claim 2, further comprising means for insulating and positioning said second wire including a nonconductive switch body enclosing said second wire and containing an opening adjacent said worm gear through which said wire head end projects for positioning.

4. The switch of claim 3, wherein said second wire is a spring held in a compressed position at the opening in said switch body.

5. The switch of claim 3, further comprising an electrically conductive operator base on which said worm gear is rotatably mounted, wherein said first wire is electrically connectable to said worm gear through said operator base.

6. The switch of claim 5, wherein said switch body includes a leg extending through said operator base enabling said second wire to be connected to a wire extending through the underside of said base.

7. In combination with an operator having a base and a worm gear which drives a mechanism for opening and closing a casement or awning window, an alarm system comprising:

alarm means actuated by a sequence of electrical pulses;

a switch for generating a pulse in a circuit in said alarm means, including:

a first wire comprising one portion of said circuit, said first wire being insulated from said operator base and having one end held adjacent said worm gear to provide an intermittent wiping contact when said worm gear is rotated;

a second wire between said alarm means and said operator base;

wherein said worm gear and said operator base are electrically conductive and in contact with one another.

8. The alarm system of claim 7, wherein said first wire is insulated from said operator base by a nonconductive switch body which encloses said first wire, said switch body being secured to the top of said base and including a leg extending through said base to enable said first wire to exit through the bottom of said base.

9. The alarm system of claim 8, wherein said one end of said first wire includes a contact head projecting through an opening in said switch body next to said worm gear, said first wire acting as a compressed spring to maintain said head in its projected position.

10. A window operator for use with an alarm package, comprising:

operator linkage means for opening and closing a window;

a movable member having an irregular surface for operating said linkage means when moved;

a contact head fixedly held adjacent said movable member to provide an intermittent contact with the irregular surface when said member moves; and a first lead wire extendable from said contact head to said alarm package.

11. The window operator of claim 10, further comprising a second lead wire connecting said movable member to said alarm package and a switch body holding said contact head and insulating it from said movable member except through said intermittent surface contact.

12. The window operator of claim 10, wherein said irregular surface defines raised ridges of a gear.

13. In combination with a window operator having an operator mechanism for opening and closing a window, said mechanism including a linkage connectable to the window and a rotatable member with an irregular surface for operating said linkage, an alarm comprising:

a switch head fixedly held next to said irregular surface and providing an intermittent contact therewith when said member is rotated; and means for electrically connecting said switch head to an alarm package whereby said contact generates a signal to trigger said alarm.

14. The combination of claim 13, wherein said connecting means comprises a circuit connected to said alarm package and extending across said switch head and said rotatable member, whereby said circuit is closed by the contact of said head with said member.

* * * * *